US006666053B2

(12) United States Patent
Sadler

(10) Patent No.: US 6,666,053 B2
(45) Date of Patent: Dec. 23, 2003

(54) REVERSIBLE SPRING-LOADED LOCK SLIDE

(75) Inventor: Dennis Sadler, Irmo, SC (US)

(73) Assignee: Randall C. Hansen, Columbia, SC (US)

( * ) Notice: Subject to any disclaimer, the term of this patent is extended or adjusted under 35 U.S.C. 154(b) by 0 days.

(21) Appl. No.: 10/025,297

(22) Filed: Dec. 19, 2001

(65) Prior Publication Data

US 2003/0110819 A1 Jun. 19, 2003

(51) Int. Cl.[7] ..... E05B 13/10; G05G 5/00

(52) U.S. Cl. ..... 70/210; 70/207; 70/468; 292/DIG. 30

(58) Field of Search ..... 70/207–211, 468–470, 70/477, 478, DIG. 53, DIG. 54, DIG. 55; 292/DIG. 31, 304, 240, 197, DIG. 30–34

(56) References Cited

U.S. PATENT DOCUMENTS

| | | | | |
|---|---|---|---|---|
| 2,682,763 A | * | 7/1954 | Williams | 70/211 |
| 4,126,340 A | | 11/1978 | Pelcin | |
| 4,276,760 A | * | 7/1981 | Nolin | 70/107 |
| 4,418,552 A | * | 12/1983 | Nolin | 70/107 |
| 4,420,954 A | | 12/1983 | Hieronymi et al. | |
| 4,438,964 A | * | 3/1984 | Peters | 292/216 |
| 4,671,547 A | | 6/1987 | Weinerman et al. | |
| 4,706,478 A | | 11/1987 | Swan et al. | |
| 4,892,338 A | | 1/1990 | Weinerman et al. | |
| 4,951,486 A | * | 8/1990 | Braun et al. | 70/208 |
| 4,989,907 A | | 2/1991 | Edmonds et al. | |
| 5,015,019 A | * | 5/1991 | Razdolsky | 292/200 |
| 5,388,435 A | * | 2/1995 | Bailey | 70/101 |
| 5,526,660 A | | 6/1996 | Bennett et al. | |
| 5,564,295 A | * | 10/1996 | Weinerman et al. | 70/208 |
| 5,586,458 A | * | 12/1996 | Weinerman et al. | 70/208 |
| 5,820,174 A | * | 10/1998 | Parikh et al. | 292/126 |
| 5,941,104 A | | 8/1999 | Sadler | |
| 5,983,682 A | * | 11/1999 | Parikh | 70/208 |
| 5,984,383 A | | 11/1999 | Parikh et al. | |
| 6,007,114 A | * | 12/1999 | Hotzl | 292/34 |
| 6,454,321 B1 | * | 9/2002 | Parikh | 292/216 |

OTHER PUBLICATIONS

Hansen Commercial & Industrial Hardware Catalogue, pp. 17, 21, 22, and 23.

* cited by examiner

*Primary Examiner*—John B. Waesh
(74) *Attorney, Agent, or Firm*—Dority & Manning, P.A.

(57) ABSTRACT

A reversible spring loaded lock slide assembly for use in locking a door latch is provided. The assembly includes a spring loaded slide case. A lock slide is in sliding engagement with the spring loaded slide case and has a first and second cavity. The lock slide has a contact member at one end and is capable of being placed in two orientations. A spring biases the lock slide relative to the spring loaded slide case.

19 Claims, 5 Drawing Sheets

REVERSIBLE SPRING-LOADED LOCK SLIDE

FIELD OF THE INVENTION

The present invention relates generally to lock slides, and relates more particularly to a reversible spring-loaded lock slide.

BACKGROUND

Doorknobs and latch handles are well known in the prior art for providing a mechanism by which a user can open or close a door or cabinet. Often, such handle assemblies are provided with a handle that can be rotated by the user. A lock cam may be provided, being attached to a shaft connected to the handle. This lock cam has a latching arm extending therefrom that rotates into or out of an opening in a door jamb. In addition to doors, handle assemblies can also be used in opening cabinets, drawers, or for other similar applications.

Handle assemblies need to be connected to the cabinet or door. Also, the latching arm on the lock cam needs to be positioned so that it will enter an opening in the door jamb or wall. When engaged in this opening, pulling on the handle will not open the cabinet or door because the latching arm will catch on the door jamb and prevent motion. When the latching arm is swung out from this opening, nothing impedes its motion and the door can be freely swung or slid into the open position.

Mechanisms used to lock the lock cam of a handle assembly in a position and hence prevent the door or cabinet from being opened are known in the prior art. Typically, a lock slide is moved into an opening in the lock cam. The lock cam is prevented from rotating due to the presence of the lock slide. The lock slide itself is prevented from moving due to its connection with a lock cylinder having a key a user may turn. Turning of the key results in linear movement of the lock slide out of the opening in the lock cam, and hence allows the door to be opened.

T-handle and D-ring handle door latches are typically employed on emergency vehicles, such as fire engines and ambulances, due to their relatively simple but reliable mechanisms, and their attractive appearance and aerodynamic shape. These handle assemblies have the handle positioned inside of a recess in the surface of the vehicle. A user will generally rotate the handle in one plane so that it is no longer positioned inside of the recess. Next, the user will rotate the handle in a perpendicular plane that will result in the door being opened. A door latch which is representative of the prior art is a locking, folding, T-handle door latch produced by Hansen International of Columbia, S.C.

Although the prior art provides a handle assembly that makes use of a locking cylinder to lock a lock cam in place, the prior art does not provide a way to use the same locking cylinder in a handle assembly when the depth of the tray is made shallower or deeper. The prior art would require a newly sized locking cylinder to be used if the location of the tray or lock slide were changed. Additionally, the prior art requires a newly sized tray and/or lock slide to be used if the length of the lock cylinder is varied. The present invention overcomes these deficiencies by providing a reversible spring-loaded lock slide that can compensate for size changes in the lock cylinder, tray, and/or lock slide.

SUMMARY

Objectives and advantages of the invention will be set forth in part in the following description, or may be obvious from the description, or may be learned through practice of the invention.

According to one aspect of the invention, a handle assembly is provided. The handle assembly is composed of a tray that has opposite sides. Also, a shaft is provided that rotatably extends through the tray. A handle is connected to the shaft so as to rotate the shaft relative to the tray, and the handle is on one side of the tray. A lock cam is on an opposite side of the tray. The lock cam is connected to the shaft so as to rotate with the shaft relative to the tray. The lock cam has at least one lock slide opening.

A reversible spring-loaded lock slide assembly having a lock slide is present. The lock slide has a body with an end movable into the lock slide opening to lock the lock cam. The lock slide has a contact member extending substantially perpendicular to the lock slide body on one end of the lock slide. The lock slide is mountable within the lock slide assembly in two orientations. A spring is provided in order to bias the lock slide in an unlocking direction. A lock arm is engageable with the contact member of the lock slide. Engagement of the lock arm with the contact member urges the lock slide in a locking direction.

Another aspect of the invention may include a handle assembly as discussed above further having a lock cylinder that engages the lock arm. Rotation of the lock cylinder causes the lock arm to rotate.

A further configuration of the invention may include a handle assembly as discussed above wherein the contact member of the lock slide has a planar surface.

Also, the invention may include a handle assembly as discussed above further including a spring-loaded slide case attached to one side of the tray. The lock slide is in sliding engagement with the spring-loaded slide case. One end of the spring contacts the spring-loaded slide case.

In another aspect of the present invention, a reversible spring-loaded lock slide assembly for use in locking a door latch is provided. This lock slide assembly includes a spring-loaded slide case. Also, a lock slide is placed in sliding engagement with the spring-loaded slide case. The lock slide has a contact member located at one end, and is capable of being placed in two orientations. The lock slide also has a first cavity and a second cavity. A spring is provided to bias the lock slide relative to the spring-loaded slide case.

Also according to another aspect of the present invention, a handle assembly for use in opening a compartment is provided. The handle assembly includes a tray having opposite sides with a shaft rotatably extending through the tray. A handle is connected to this shaft in order to provide the rotational movement. The handle is located on one side of the tray. A lock cam is connected to the shaft so as to rotate with the shaft relative to the tray. The lock cam being on an opposite side of the tray. The lock has at least one lock slide opening. A spring-loaded slide case is connected to the tray. Also, a reversible spring-loaded lock slide assembly is provided. The lock slide is moveable into the lock slide opening in order to lock the lock cam. The lock slide assembly has a lock slide that has a body with an end movable into the lock slide opening in order to lock the lock cam. The lock slide has at least two cavities and has a contact member at one end. The lock slide is in sliding engagement with the spring-loaded slide case, and is capable of engaging the spring-loaded slide case in two orientations. Also provided is a spring that is used to bias the lock slide relative to the spring-loaded slide case. Additionally, a lock arm that has a cam surface is provided. The cam surface is engageable with the contact member of the lock slide. Engagement of the lock arm with the lock slide causes the lock slide to be urged in a direction opposite to the bias of the spring.

Another aspect of the present invention includes the handle assembly as described above further including a lock cylinder that engages the lock arm. Rotation of the lock cylinder causes the lock arm to rotate.

Also, the invention includes an embodiment of the handle assembly as described above wherein the contact member of the lock slide has a planar surface.

Yet another aspect of the present invention includes an embodiment of the handle assembly described above wherein the spring is contained within one of the cavities and engages the spring loaded slide case at one end of the spring. The spring biases the lock slide away from the lock slide openings.

DETAILED DESCRIPTION

Figure 1:
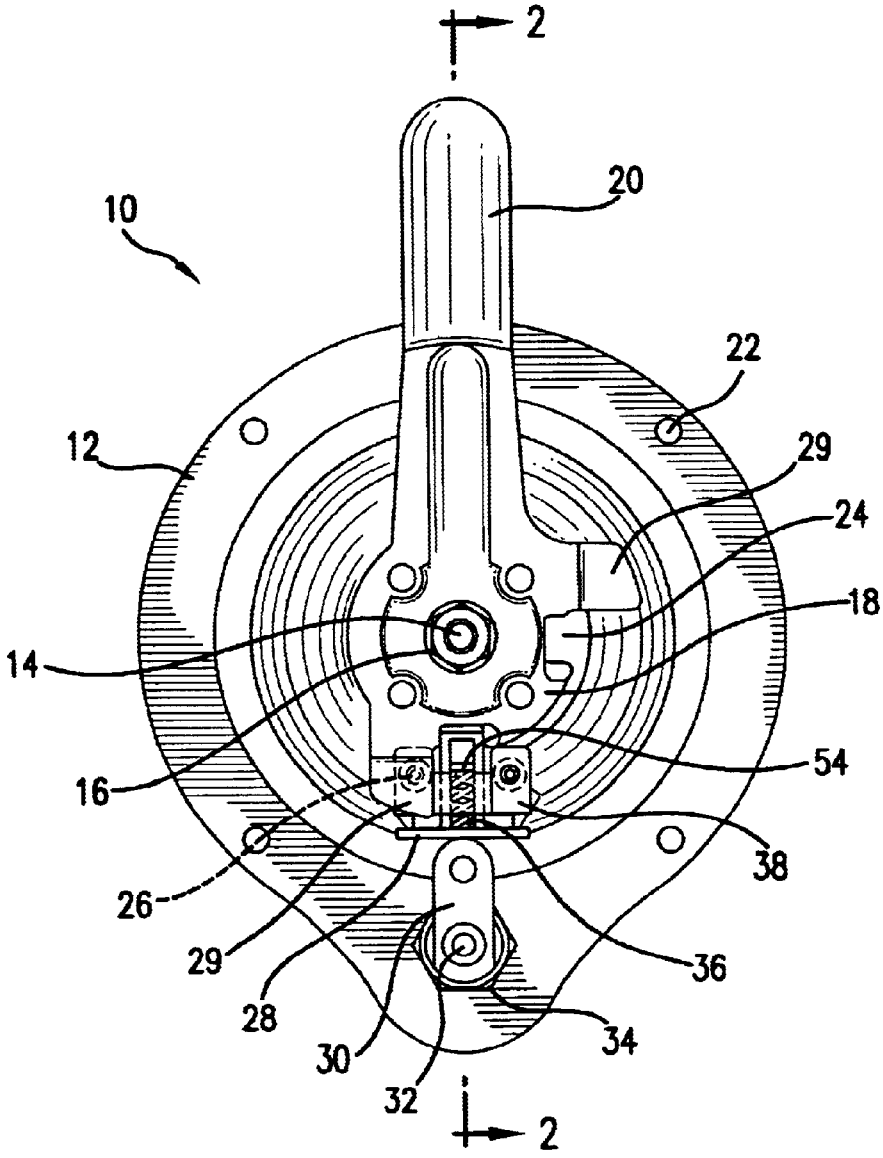
FIG. 1 is a back view of a D-ring handle assembly using an embodiment of a lock slide assembly according to certain aspects of the present invention. The drawing shows the lock cam of the lock slide assembly in a locked position.

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include such modifications and variations.

Referring now to the drawings, FIG. 1 shows one example of a handle assembly indicated generally at 10 for use in opening a door or cabinet in accordance with certain aspects of the present invention. The handle assembly 10 includes a tray 12 having optional tray holes 22 disposed about a surface of tray 12. The tray holes 22 may be used to mount the tray 12 onto a door or other compartment. The surface of tray 12 having tray holes 22 is either flush with the surface that the tray 12 is attached to, or lies just on top of the surface. Such a tray 12 is often used in many applications due to its attractive and modular appearance.

The handle assembly includes a latching arm 20 that is swung inside of a hole in a door jamb. Once inserted into such a hole, the door onto which the handle assembly 10 is attached cannot be opened. Additionally, latching arm 20 can be configured to prevent the door from opening by contacting a flange in a certain position or by its incorporation with other mechanisms. The latching arm 20 is connected to a lock cam 18. If lock cam 18 is prevented from moving, it necessarily follows that latching arm 20 is also prevented from moving due to its connection to lock cam 18. Lock cam 18 is connected to a shaft 14 by a nut 16. Shaft 14 rotates relative to tray 12, so lock cam 18 therefore can rotate relative to tray 12. As shown, lock cam 18 is provided with two lock slide openings 24.

A reversible spring-loaded lock slide 28 is configured to move into one of the lock slide openings 24. Once the lock slide 28 is inside, lock cam 18 is prevented from moving due to the contact with an end 33 of the lock slide 28. The lock cam 18 is provided with two stops 29 in order to allow for only 90 degrees of rotation of the lock cam 18. Of course, lock cam 18 can be configured without these two stops 29 in order to allow the lock cam 18 to rotate 360 degrees, and with any number or spacing of openings 24.

Handle assembly 10 also includes a compression spring 36 that biases lock slide 28 in an unlocking direction. Both spring 36 and lock slide 28 are at least partially contained within spring-loaded slide case 38. Lock slide 28 is moveable relative to the spring-loaded slide case 38. Spring-loaded slide case 38 is attached to tray 12 via two rivets 26. The spring 36 is configured within lock slide 28 and contacts spring-loaded slide case 38 at a flange 54 extending from slide case 38. Spring 36 biases lock slide 28 into a position away from the lock cam 18. In such a fully biased position, lock slide 28 is completely removed from the lock slide openings 24 and hence lock cam 18 is free to rotate relative to tray 12, at least within the limits of stops 29. When spring 36 is compressed, lock slide 28 may move into one of the lock slide openings 24. Such a situation results in lockage of lock cam 18.

The mechanism used to compress spring 36 is shown in FIG. 1 as lock arm 30. Lock arm 30 is connected to and rotates with lock cylinder 32. Lock cylinder 32 is connected to tray 12 by nut 34. Actuation of the lock cylinder 32 causes lock arm 30 to rotate. Rotation towards a planar surface on lock slide 28 eventually results in contact between the two. Further rotation results in a compression of spring 36 and movement of lock slide 28 towards the lock cam 18. If a lock slide opening 24 is aligned with the lock slide 28, the lock slide 28 will enter the lock slide opening 24 and lock the handle assembly. Rotation of the lock arm 30 away from the planar surface of lock slide 28 causes the lock slide 28 to move linearly away from lock cam 18. This eventually results in the lock slide 28 being removed from the lock slide opening 24 and hence allows the lock cam 18 and latching arm 20 to rotate.

Figure 2:
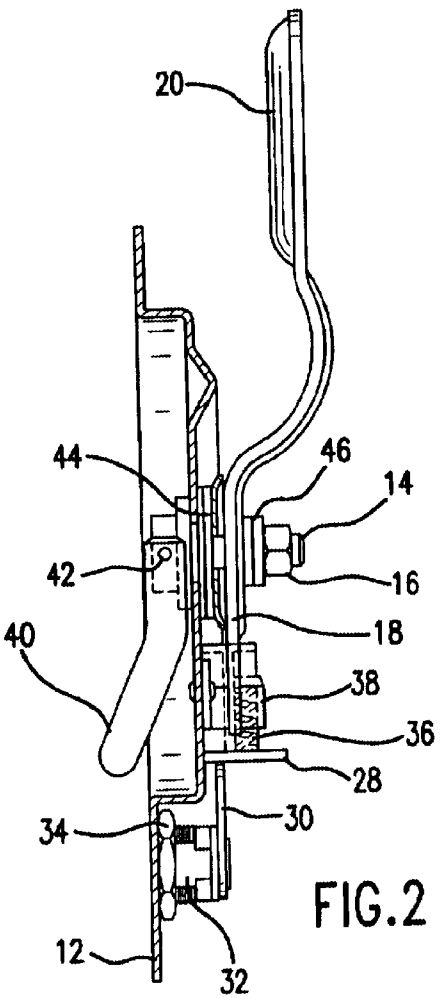
FIG. 2 is a partial sectional side view of the handle assembly taken along line 2—2 in FIG. 1 with only the tray portion in section for clarity.

FIG. 2 shows a partial sectional side view taken along line 2—2 of FIG. 1. Latching arm 20 is shown as having a curved section, although it is to be understood that the latching arm 20 may be of various configurations. Lock cam 18 is attached to the shaft 14 by a nut 16 and washer 46 combination. The handle 40 shown in FIG. 2 is a D-shaped handle having a section being angled away from the tray 12. A handle connection arrangement 42 is shown being used to attach handle 40 to the shaft 14. Handle 40 can be rotated away from tray 12 out of the compartment in tray 12 and then rotated about the shaft. A handle biasing assembly 44 is provided to allow for a smooth outward movement and rotation of handle 40. A handle biasing assembly 44 is also used to properly space the lock cam 18 from tray 12.

Figure 3:
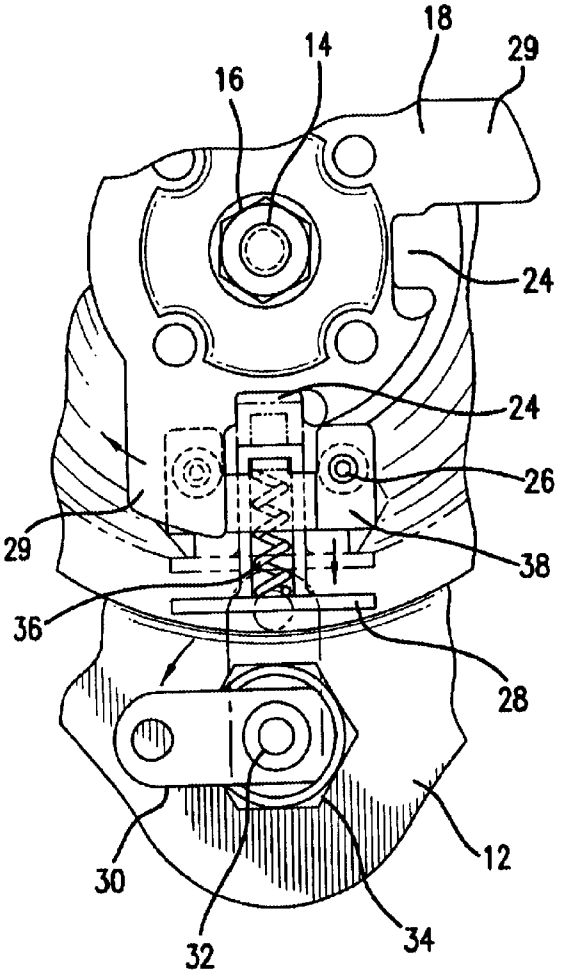
FIG. 3 is a close-up view of the lock slide assembly shown in FIG. 1. The drawing shows the lock slide and the lock arm in both a locked (dotted lines) and an unlocked (solid lines) position.

FIG. 3 shows an enlarged view of the lock slide assembly of FIG. 1. FIG. 3 shows the lock cam 18 in both a locked and an unlocked arrangement. Shown in solid lines, when the lock arm 30 is rotated away from the lock cam 18 the lock slide 28 also moves away from lock cam 18 due to the spring 36 biasing force until the lock slide 28 contacts flange 54. In such an arrangement, lock cam 18 is free to rotate relative to tray 12. Shown in phantom lines, when the lock arm 30 is rotated towards the lock cam 18, the lock slide 28 is forced into lock slide opening 24. In such a configuration spring 36 is compressed. Lock slide 28 is shown in phantom lines being placed inside of lock slide opening 24 and hence locking the lock cam 18 and preventing it from rotating relative to tray 12.

Figure 4:
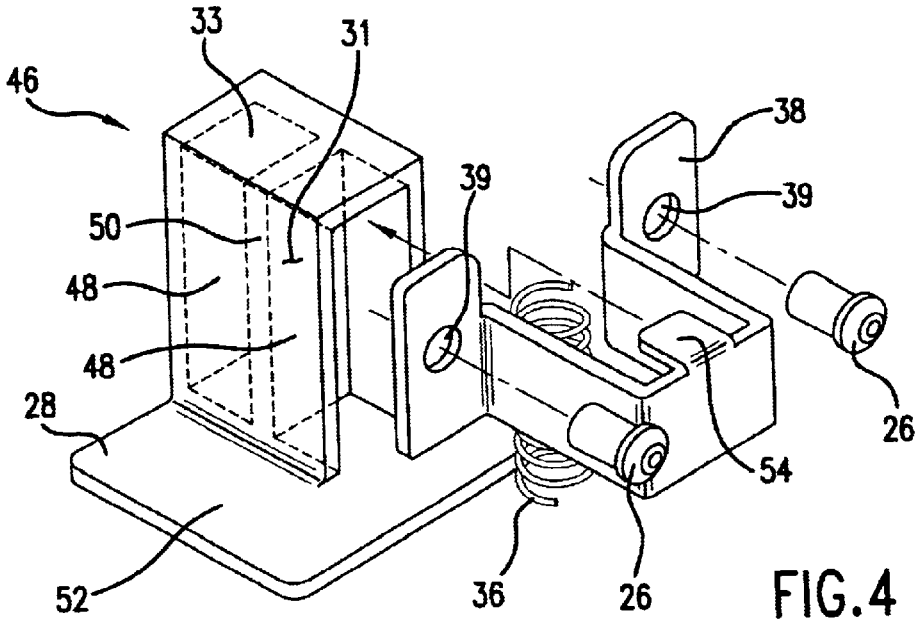
FIG. 4 is an exploded perspective view of an embodiment of a lock slide assembly of the present invention.

FIG. 4 shows an exploded perspective view of the reversible spring-loaded lock slide assembly 46 of the present invention. Lock slide 28 is shown as having two cavities 48. A wall 50 separates these two cavities 48. A contact member 52 is provided at one end of lock slide 28 and contacts both the wall 50 and also the two cavities 48. A spring-loaded slide case 38 is provided with two holes 39. Rivets 26 are inserted into these two holes 39 to connect the spring-loaded slide case 38 to another structure. Spring 36 is housed within one of the cavities 48. Spring 36 is engaged on one end against contact member 52 and on the other end against flange 54.

Referring back to FIG. 2, it can be seen that lock arm 30 engages the lock slide 28 at the contact member 52. This engagement occurs at one end of the contact member 52. If it were the case that lock cylinder 32 were longer it could be the case that lock arm 30 would not engage contact member 52 at all. In order to compensate for various lengths of lock cylinders, and also for various depths and sizes of tray 12, the present invention allows for a user to reconfigure the reversible spring-loaded lock slide assembly 46 so that the lock arm 30 engages contact member 52 of the lock slide 28. This adjustment is found by way of inverting the position of the lock slide 28 and positioning the spring 36 within the second cavity 48. As can be seen from FIG. 4, reversal of the lock slide 28 so that the opposite cavity 48 is used results in the direction of extension of the contact member 52 also being reversed. This reversal of contact member 52 allows for a change in its position relative to the lock arm 30. Such a position change would be necessary in order to ensure engagement of the lock arm 30 and contact member 52 if various sizes of lock cylinders 32 and 104 trays 12 are used. Additionally, this reversal allows for other dimensional variations to be compensated for.

Figure 5:
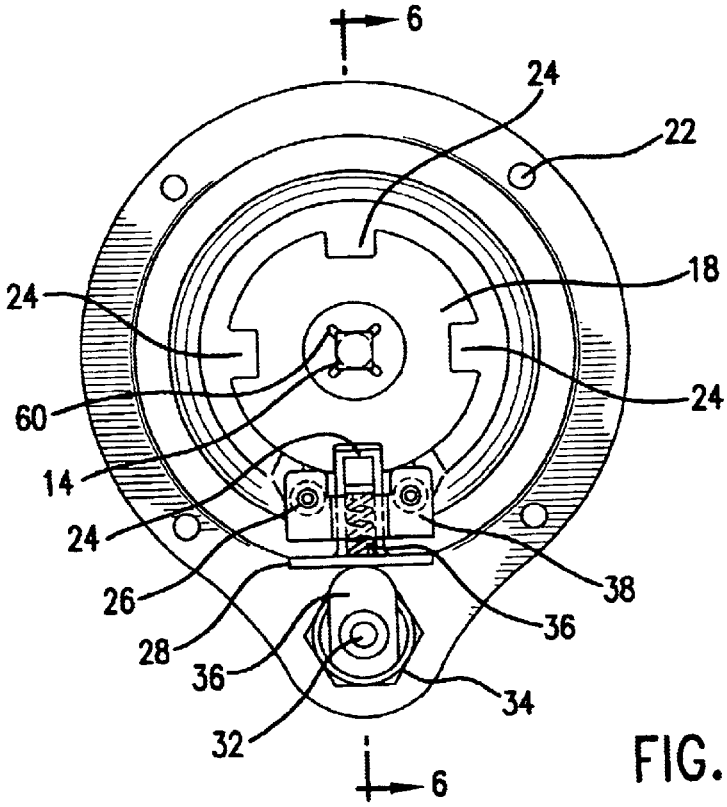
FIG. 5 is a back view of an alternate D-ring handle assembly having a lock cam having four lock slide openings.

FIG. 5 shows an alternative embodiment of the handle assembly for use in opening a compartment of the present invention. The drawing shows a back view of such an assembly. The handle assembly of FIG. 5 differs from the handle assembly of FIG. 1 in that the lock cam 18 and shaft 14 are slightly different. Lock cam 18 is here provided with four lock slide openings 24. Shaft 14 is different in that it provides for a lock key 60 to attach the lock cam 18 to shaft 14. In FIG. 1, this attachment arrangement consists of a nut 16 being used to attach shaft 14 to lock cam 18.

Figure 6:
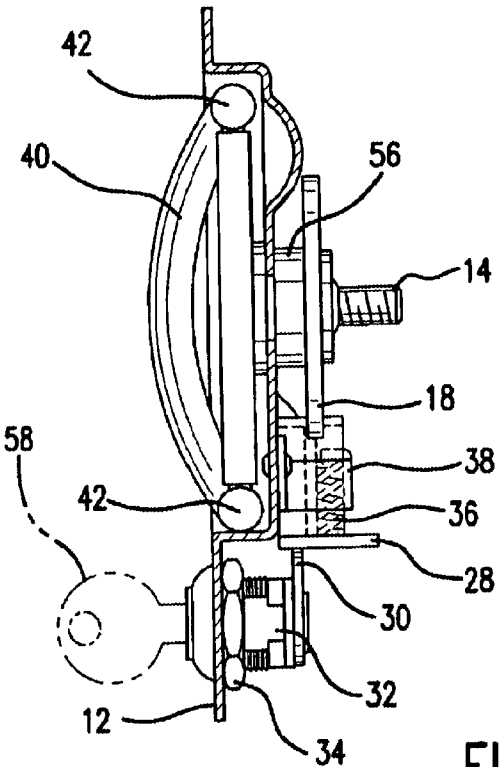
FIG. 6 is a partial sectional side view of the handle assembly taken along line 6—6 of FIG. 5, with only the tray portion in section for clarity.

FIG. 6 is a partial sectional side view of the handle assembly of FIG. 5 taken along line 6—6 of FIG. 5. The handle 40 is shown in this drawing as a D-ring handle. The D-ring handle 40 is connected to the shaft 14 through a connection arrangement 42. A lock cam spacer 56 is provided to appropriately space the lock cam 18 from tray 12. A key 58 is shown inserted into lock cylinder 32 in order to actuate lock cylinder 32 and hence rotate lock arm 30. Engagement of lock arm 30 with lock slide 28 causes the lock slide 28 to move into or out of one of the four lock slide openings 24. The position of lock slide 28 is the same, relative to the slide case 38, in FIGS. 2 and 6.

Figure 7:
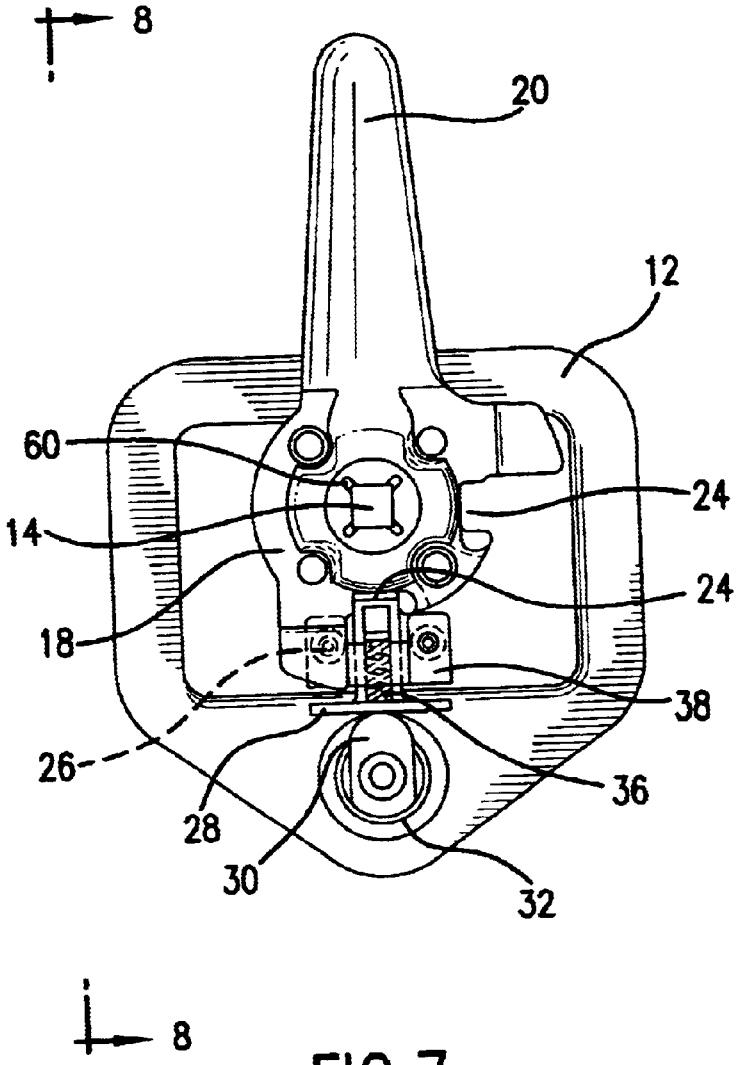
FIG. 7 is a back view of an alternate folding-T handle assembly using an embodiment of a lock slide assembly according to certain aspects of the present invention. The drawing shows the lock cam in a locked position.

FIG. 7 is an alternative embodiment of the handle assembly of the present invention. Latching arm 20 is shown in this drawing as being a single arm extending from lock cam 18. Unlike the latching arm of FIG. 1, the latching arm in FIG. 7 does not have a curved section. Also, a lock key 60 is used in place of the nut 16 to attach the lock cam 18 onto shaft 14. The lock slide assembly used in FIG. 7 is similar to that discussed in the previous embodiments, although the position of lock slide 28 is reversed.

Figure 8:
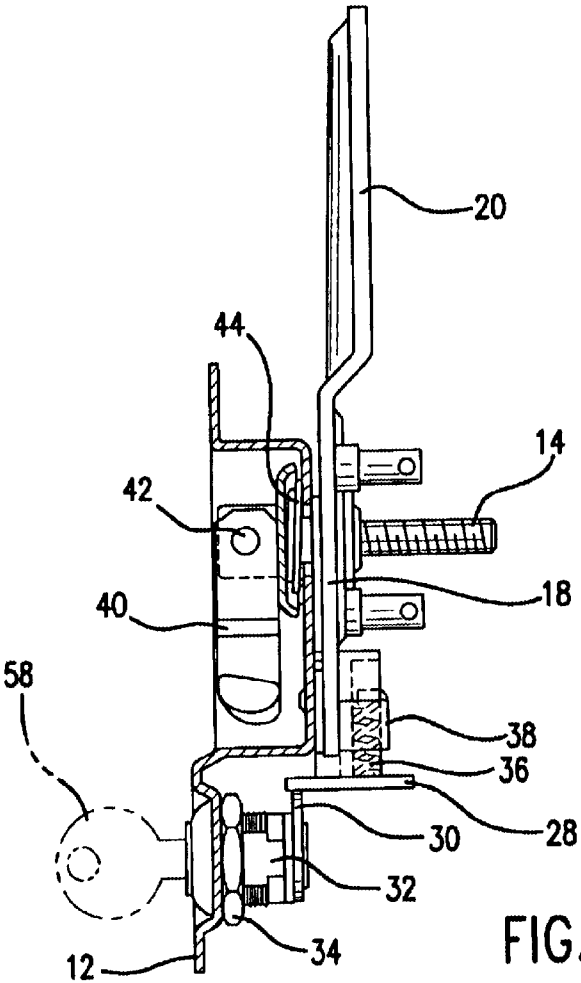
FIG. 8 is a partial sectional side view taken along line 8—8 of FIG. 7, with only the tray portion in section for clarity.

FIG. 8 shows a partial sectional side view of the handle assembly of FIG. 7 taken along line 8—8 of FIG. 7. The handle 40 used in this embodiment is a folding T-lock handle. Such a handle rotates about the connection 42 to shaft 14. Connection 42 is shown in this drawing as a pin which allows the folding T-lock handle 40 to rotate out of the tray 12. Once rotated out, folding T-lock handle 40 can be rotated by a user. A handle biasing assembly 44 is provided to allow for a smooth removal and rotation of the folding T-lock handle 40.

The reversible spring-loaded lock slide assembly 46 is reversed in the embodiment shown in FIG. 8 from that embodiment shown in FIG. 6. This is due to the fact that lock arm 30 does not extend past the recess in tray 12 in FIG. 8. Reversal of the lock slide 28 allows the lock arm 30 to engage the contact member 52. As can be seen, the same reversible spring-loaded lock slide assembly 46 can be used on different assemblies having various locations of the lock arm 30 and lock cam 18 (due to the depth of the recess in tray 12). Using the same assembly 46 on different handles allows for a more economical, modularized, and uniform product.

It will be appreciated that various modifications and changes may be made to the above described preferred embodiments of a reversible spring-loaded lock slide assembly and a handle assembly without departing from the scope of the following claims.

I claim:

1. A handle assembly for use in opening a compartment, the assembly comprising:

a tray having opposite sides;

a shaft rotatably extending through the tray;

a handle connected to the shaft so as to rotate the shaft relative to the tray, the handle being on one side of the tray;

a lock cam connected to the shaft so as to rotate with the shaft relative to the tray, the lock cam being on an opposite side of the tray, the lock cam having at least one lock slide opening;

a reversible spring loaded lock slide assembly having a lock slide, the lock slide having a body with an end movable into the lock slide opening to lock the lock cam, the lock slide having a contact member extending substantially perpendicular to the lock slide body on one end of the lock slide, the lock slide being mountable within the lock slide assembly in two orientations;

a spring used to bias the lock slide in an unlocking direction; and a lock arm engageable with the contact member of the lock slide, engagement of the lock arm and the contact member urging the lock slide in a locking direction.

2. The handle assembly of claim 1, further comprising a lock cylinder engaging the lock arm, rotation of the lock cylinder causes the lock arm to rotate.

3. The handle assembly of claim 1, wherein the lock arm has an end that is rounded.

4. The handle assembly of claim 1, wherein the contact member of the lock slide has a planar surface.

5. The handle assembly of claim 1, wherein the spring biases the lock slide away from the lock slide opening.

6. The handle assembly of claim 1, wherein the handle is D-shaped.

7. The handle assembly of claim 1, wherein the handle is T-shaped and the handle is capable of being placed inside the tray.

8. The handle assembly of claim 1, further comprising a spring loaded slide case attached to one side of the tray, the lock slide is in sliding engagement with the spring loaded slide case, and wherein the spring at one end contacts the spring loaded slide case.

9. The handle assembly of claim 8, further comprising a lock cylinder connected to the tray and connected to the lock arm.

10. A reversible spring loaded lock slide assembly for use in locking a door latch comprising:

a spring loaded slide case;

a lock slide in sliding engagement with the spring loaded slide case having a first cavity and a second cavity both the first and second cavities are configured to receive a spring, the lock slide having a contact member at one end capable of being placed in two orientations relative to the spring loaded slide case, the contact member being non-symmetrically disposed with reference to the first and second cavities; and a spring biasing the lock slide relative to the spring loaded slide case, the spring configured so as to be selectively insertable into either of the first or second cavities, depending on in which of the two orientations the contact member is disposed.

11. The reversible spring loaded lock slide assembly of claim 10, wherein the spring is contained within one of the cavities and engages the spring loaded slide case at one end of the spring.

12. The reversible spring loaded lock slide assembly of claim 11, wherein the contact member has a planar surface.

13. A handle assembly for use in opening a compartment comprising:

a tray having opposite sides;

a shaft rotatably extending through the tray;

a handle connected to the shaft so as to rotate the shaft relative to the tray, the handle being on one side of the tray;

a lock cam connected to the shaft so as to rotate with the shaft relative to the tray, the lock cam being on an opposite side of the tray, the lock cam having at least one lock slide opening;

a spring loaded slide case connected to the tray;

a reversible spring loaded lock slide assembly having a lock slide, the lock slide having a body with an end movable into the lock slide opening in order to lock the lock cam, the lock slide having at least two cavities and having a contact member at one end, the lock slide being in sliding engagement with the spring loaded slide case and capable of engaging the spring-loaded slide case in two orientations;

a spring biasing the lock slide relative to the spring loaded slide case; and a lock arm having a cam surface, the cam surface engageable with the contact member of the lock slide, engagement of the lock arm with the lock slide causes the lock slide to be urged in a direction opposite to the bias of the spring.

14. The handle assembly of claim 13, further comprising a lock cylinder engaging the lock arm, rotation of the lock cylinder causes the lock arm to rotate.

15. The handle assembly of claim 14, wherein the lock cylinder is connected to the tray.

16. The handle assembly of claim 13, wherein the contact member of the lock slide has a planar surface.

17. The handle assembly of claim 13, wherein the spring is contained within one of the cavities and engages the spring loaded slide case at one end of the spring, the spring biases the lock slide away from the lock slide openings.

18. The handle assembly of claim 13, wherein the handle is D-shaped.

19. The handle assembly of claim 13, wherein the handle is T-shaped and the handle is capable of being placed inside the tray.

* * * * *